US010383408B2

(12) United States Patent
Tamura et al.

(10) Patent No.: US 10,383,408 B2
(45) Date of Patent: Aug. 20, 2019

(54) SLIDE FASTENER CHAIN

(71) Applicant: YKK Corporation, Tokyo (JP)

(72) Inventors: Kazuo Tamura, Cheshire (GB); Haruo Matsushima, Toyama (JP)

(73) Assignee: YKK Corporation (JP)

( * ) Notice: Subject to any disclaimer, the term of this patent is extended or adjusted under 35 U.S.C. 154(b) by 128 days.

(21) Appl. No.: 15/348,265

(22) Filed: Nov. 10, 2016

(65) Prior Publication Data

US 2017/0135447 A1 May 18, 2017

(30) Foreign Application Priority Data

Nov. 18, 2015 (GB) ..... 1520349.0

(51) Int. Cl.
*A44B 19/24* (2006.01)
*A44B 19/60* (2006.01)
*A44B 19/36* (2006.01)

(52) U.S. Cl.
CPC ..... *A44B 19/36* (2013.01); *A44B 19/60* (2013.01); *Y10T 24/25* (2015.01)

(58) Field of Classification Search
CPC ..... A44B 19/00; A44B 19/02; A44B 19/04; A44B 19/06; A44B 19/10; A44B 19/24; A44B 19/34; A44B 19/36; A44B 19/42; Y10T 24/25
See application file for complete search history.

(56) References Cited

U.S. PATENT DOCUMENTS 4,187,591 A 2/1980 Akashi
4,190,944 A 3/1980 Yoshida et al.
4,190,945 A 3/1980 Yoshida et al.
5,536,343 A 7/1996 Kuse
9,220,324 B1 * 12/2015 Nunn ..... A44B 19/38
(Continued)

FOREIGN PATENT DOCUMENTS

CN 103260453 B 9/2015
EP 1842445 A1 10/2007
GB 1073424 A 6/1967
(Continued)

OTHER PUBLICATIONS

Office Action, Korean Patent Application No. 10-2016-0153627, dated Dec. 18, 2017.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

A slide fastener chain includes a first tape and a second tape. A row of coupling elements is fixed along an inner edge of the first tape. A row of coupling elements is fixed along an inner edge of the second tape. The coupling elements of the first and second tapes being arranged such that the coupling elements of the first tape interdigitate with coupling elements of the second tape so as to secure the first and second tapes together. The chain includes a bottom stop. At least one of the tapes is provided with an extension portion which extends beyond a bottom stop portion of the tape. A width of the extension portion is less than a width of a portion of the tape which does not form part of the extension portion.

20 Claims, 5 Drawing Sheets

(56) References Cited

U.S. PATENT DOCUMENTS

| | | | |
|---|---|---|---|
| 2013/0007993 | A1 | 1/2013 | Kozato et al. |
| 2014/0215771 | A1 | 8/2014 | Hayashi et al. |

FOREIGN PATENT DOCUMENTS

| | | | |
|---|---|---|---|
| GB | 1173019 | A | 12/1969 |
| GB | 2000548 | A | 1/1979 |
| JP | S50-044242 | Y1 | 12/1975 |
| JP | S54-012944 | | 1/1979 |
| JP | S58-052641 | B2 | 11/1983 |
| JP | S58-166707 | U | 11/1983 |
| JP | S61-077811 | U | 5/1986 |
| JP | H07-075604 | A | 3/1995 |
| TW | 2010-29596 | A | 8/2010 |
| TW | 2011-36547 | A | 11/2011 |

OTHER PUBLICATIONS

Office Action, Taiwanese Patent Application No. 105137384, dated Aug. 18, 2017.
Search Report, British Patent Application No. 1520349.0, dated May 9, 2016.
Office Action, Chinese Patent Application No. 201611035280.5, dated Feb. 2, 2019.

* cited by examiner

PRIOR ART

SLIDE FASTENER CHAIN

The present application claims priority to British Patent Application No. 1520349.0, filed on Nov. 18, 2015 and entitled "Slide Fastener Chain and Method of Preparing Slide Fastener Chain," the entire contents of which are hereby incorporated by reference.

TECHNICAL FIELD

The present invention relates to a slide fastener chain and to a method of preparing the slide fastener chain.

BACKGROUND

Slide fasteners are well known. A conventional slide fastener comprises a pair of stringers (referred to collectively as a chain) and an opening and closing means referred to as a slider. Each stringer comprises a tape, a cord and a plurality of coupling elements. The tape may be knitted, woven or formed of a non-woven material. The coupling elements extend along one edge of each tape, and when the slide fastener is in a closed configuration the coupling elements on one tape co-operate in an interdigitating relationship with the coupling elements on the second tape so as to secure the first and second tapes together. Consequently, when each tape of the slide fastener is attached to a piece of material, the pieces of material may be joined by closing the slide fastener using the slider, thereby bringing the coupling elements into the interdigitating relationship.

As the slider moves as it opens and closes the slide fastener, it is necessary to ensure that the slider cannot move beyond the teeth and possibly detach from the slide fastener. For this reason stops, selected from a variety known in the art, may be provided at one or more ends of the slide fastener.

Stops that are provided to prevent the slider sliding off the slide fastener when the slider is moved in a direction to close the slide fastener are called top stops, whilst stops that are provided to prevent the slider sliding off the slide fastener when the slider is moved in a direction to open the slide fastener are called bottom stops. A slide fastener including a bottom stop that permanently secures both tapes of the fastener together is known as a closed end slide fastener. A slide fastener including a bottom stop that comprises a two-part bottom stop (e.g., a box and a pin, but not limited to this), which releasably attaches the first tape to the second tape, is known as an open end slide fastener. Each part of the two-part bottom stop is secured to a respective tape. The two parts of the bottom stop co-operate so that when the slide fastener is closed the bottom stop secures the tapes of the slide fastener together.

Due to their versatility, slide fasteners are employed in a wide range of applications including clothing, luggage, home furnishings and upholstery.

The versatility of slide fasteners also means that they are used with a variety of materials ranging from hardwearing denim and cotton to lightweight silks and polyester.

It is common for slide fasteners to be mass-produced. In such mass production methods the tape (or chains) of multiple slide fasteners may be produced in continuous lengths. This means that during the manufacturing process the tape (or chain) of each slide fastener will need to be cut to the length desired by the manufacturer. Whilst there are a variety of methods to cut the tape, in a large number of cases, cutting the tape raises the possibility that the tape will fray from the cut.

To minimise fraying of the tape it is commonplace to attach a piece of reinforcing material (such as taffeta, nylon or other such material) to the cut region at one end or both ends of the tapes of an open end slide fastener.

Another known option for minimising fraying is for a section of tape which continues beyond the coupling elements to be provided beyond the top stop of the slide fastener. Such a section is commonly referred to as an 'elongate region' or 'extension portion'. The extra length is used to attach the slide fastener more securely, simply because there is more material to attach, but this extra length also delays the effects of fraying because if some of this material frays, it will have very little to no effect on the function of the slide fastener once attached.

The use of additional reinforcing material adds weight and depth to the slide fastener. For a large number of items the reinforced tapes do not cause a problem. However, for lightweight material, when the slide fastener is sewn into place the reinforcing material leads to a bulky appearance which spoils the overall aesthetic appearance of a garment to which the slide fastener is applied.

In addition, for wider slide fasteners, the width of the reinforcing material may be limited, with the effect that it may not be straightforward to cover the entire width of the tape with the reinforcing material. As such, fraying may occur at portions of the tape of a slide fastener which is not covered by reinforcing material.

When applying a slide fastener to a garment, folding back the elongate region so that it overlaps with the remaining portion of the respective tape will double the thickness of the tape and create a bulky region.

When using lightweight material, it is known to fold the elongate region at an angle to the coupling elements so that the elongate region protrudes perpendicularly to the direction of the coupling elements. The elongate region is then sewn into the item to which it is to be attached.

However, with lightweight material, a double-thickness folded portion of tape or an angled folded elongate region may still create an extra thickness which may make the garment appear unnecessarily bulky. Additionally, when the tape is wide, folding the tape back in this manner creates a large folded area.

Consequently, for items made of lightweight material, such as for example in eveningwear and sportswear, it is desirable to use slide fasteners made with tapes of reduced thickness to achieve a garment with a smooth appearance when the slide fastener is sewn into place. For some materials however, especially for sportswear, using lightweight stringers (i.e. stringers including tape of reduced thickness) may lead to a garment in which either the slide fastener is prone to detaching, or, may result in a garment in which the overall aesthetic appearance is compromised due to the tapes still being too thick.

Additionally, when an open end slide fastener is used, it is common that the bottom stop of the slide fastener will be in line with an edge of the article to which it is attached. In many cases when the article contains a hem or sewing line at its edge, for example in a garment, the tape adjacent the bottom stop will have a different appearance to the edge of the article and create an incongruency in the visual and tactile aspects of the article.

SUMMARY

The present invention seeks to overcome problems arising when existing slide fasteners are used with lightweight materials, whether mentioned above or otherwise. In addition, or alternatively, the present invention seeks to provide an alternative slide fastener to those already known.

The inventors of the present invention have found that, using a slide fastener according to the present invention, it is possible to prepare garments made, for example, from fine lightweight material in which, when a slide fastener is sewn to the material, the overall appearance is improved. That is, any uneven appearance caused by securing the slide fastener tapes to fine lightweight material is reduced or removed without impairing the quality of the slide fastener and/or the quality of the attachment of the slide fastener to the garment.

It is a further benefit of this invention that the edge of a zipper can be prepared in a manner which mimics the hem of the article to which it is attached.

According to a first aspect of the present invention there is provided a slide fastener chain comprising a first tape comprising an inner edge and an outer edge; and a second tape comprising an inner edge and an outer edge, wherein the first tape comprises a row of coupling elements fixed along the inner edge of the first tape; and the second tape comprises a row of coupling elements fixed along the inner edge of the second tape; the coupling elements of the first and second tapes being arranged such that the coupling elements of the first tape may interdigitate with coupling elements of the second tape so as to secure the first and second tapes together; and wherein the chain includes a bottom stop; and wherein the at least one of the tapes is provided with an extension portion which extends beyond the bottom stop; and wherein a width of said extension portion is less than a width of a portion of said respective tape which does not form part of said extension portion.

It will be appreciated that by providing an extension portion with a narrower width than the width of the tape which does not form part of the extension portion, the extension portion may be folded back upon itself along an axis perpendicular to the length of the tape such that the extension portion is not in contact with the coupling elements of the tape. Furthermore, it will be appreciated that such an arrangement ensures that the region of the slide faster stringer in the vicinity of the bottom stop is thin, and is unaffected by bumps or creases which would otherwise be caused by folding the full width of the tape. For example, should the extension portion be provided with the same width as the tape (or should the extension portion be wider than the tape itself), once folded in the manner described above, the extension portion would overlap the coupling elements of the tape. Such an overlap may also be detrimental to the performance of the slide fastener stringer when assembled with a slider, as it may increase the chance of interference between the tape and the slider as it passes over the coupling elements and along the stringer.

In other words, by use of a chain according to the present invention, when the extension portion is folded back upon the rest of the tape along an axis perpendicular to the length of the tape, each stringer having an extension portion according to the present invention will include a relatively thick portion (i.e. two-fold thickness) at the outer edge of the tape, whereas the stringer will also include a relatively thin portion (i.e. one-fold thickness) adjacent the coupling elements of the tape (or inner edge or cord of the tape). This relatively thin portion of the tape adjacent the coupling elements of the tape will produce a more aesthetically pleasing impression when the stringer is incorporated into a garment because it will make the stringer of the slide fastener appear less bulky.

The profile of the outer edge of the at least one tape which includes an extension portion may be a generally continuous straight line in both the extension portion and the portion of the tape other than the extension portion. In other words, the outer edge of the at least one tape which includes an extension portion may extend in a direction which is substantially parallel to a longitudinal axis of the stringer/chain/slide fastener (or parallel to the length of the tape) and/or which is substantially parallel to a sliding direction of a slider along the stringer/chain when a slider is mounted to the coupling elements to form a slide fastener.

When it is said that the extension portion extends beyond the bottom stop, what is meant is that the extension portion is located axially on one side of the bottom stop, whereas the coupling elements of the respective tape are located axially on the other side of the bottom stop. Put another way the extension portion extends from the bottom stop in a direction which is parallel to the direction, a slider, in use, will slide along the coupling elements of the tape so as to uncouple the coupling elements.

The width of the portion of the respective tape which does not form part of said extension portion refers to the width of a portion of the respective tape which is located above the bottom stop. That is to say, the bottom stop is located intermediate the extension portion and said portion of the respective tape which does not form part of said extension portion. In other words the portion of the respective tape which does not form part of said extension portion is located from the bottom stop and/or the extension portion in a direction parallel to the sliding direction, in use, of a slider which results in the coupling elements of the tapes interdigitating.

It will be appreciated that the coupling elements may be composed of plastic or metal or other appropriate material. The extension portions of each tape may be integral with the tape such that the extension portions and the tape are formed as one piece. Alternatively, the extension portions may be formed of a separate material to the tape. The extension portions may be formed by cutting or severing of the tape or the separate material. The extension portions may be formed by folding of the tape or the separate material. The length of the extension portions may be varied. The length of the extension portions may be varied based upon the article in which the slide fastener is integrated. That is to say, the length of the extension portions may be chosen so that it is appropriate to the article into which the slide fastener is to be incorporated.

It will be understood that the width of the tape is the width of the tape measured between the inner edge of the tape and the outer edge of the tape. It will further be understood that the width of each extension portion is the width measured between an inner side edge of the extension portion and an outer side edge of the extension portion. It will be appreciated that the outer side edge of the extension portion may be collinear and/or integral with the outer edge of the tape.

The width may be measured perpendicular to a longitudinal axis of the stringer/slide fastener. The width may be measured perpendicular to the length of the tape. The width may be measured perpendicular to a sliding direction of the slider when a slider has been mounted to the coupling elements of the tapes of the chain.

In accordance with a first aspect of the invention, the first tape may comprise a first bottom stop portion and the second tape may comprise a second bottom stop portion detachably attachable to the first bottom stop portion. The bottom stop may comprise the first and second bottom stop portions. The one or both extension portions may extend beyond the respective bottom stop portion of said respective tape. That is to say, if a tape of the chain includes an extension portion, then the extension portion may extend beyond the bottom stop portion of said tape.

A slide fastener which includes a second bottom stop portion which is detachably attachable to the first bottom stop portion may be referred to as an open end slide fastener. In other embodiments the bottom stop may not be detachable, such that the bottom stop permanently joins the tapes together—such a slide fastener may be referred to as a closed end slide fastener.

As already discussed, the first tape may comprise a first bottom stop portion and the second tape may comprise a second bottom stop portion. In such embodiments (according to any of the aspects of the invention discussed below), where the optional features below mention the bottom stop, in some embodiments, what may be meant by the bottom stop is the respective bottom stop portion of the tape of which a relevant extension portion forms part.

In accordance with the first aspect of the invention, the coupling elements may be configured to receive a slider, the slider being movable in a coupling direction so as to cause the coupling elements of the first and second tapes to interdigitate, and being movable in an uncoupling direction substantially opposite the coupling direction so as to cause the coupling elements of the first and second tapes to disengage; and wherein the bottom stop limits movement of the slider beyond said bottom stop portion in the uncoupling direction. It will be appreciated that the bottom stop may be located (at least in part) on the cord of one or more of the tapes.

In embodiments in which the bottom stop comprises first and second bottom stop portions, at least one of the first and second bottom stop portions may limit the movement of the slider beyond said bottom stop portion in the uncoupling direction. It will be appreciated that bottom stop portions may be located on or in part on the cords of the tape. The bottom stop portions may be located at a common end of each stringer in order to collaborate at a common end of the coupling elements on each stringer. One of the bottom stop portions may comprise a box and the other of the bottom stop portions may comprise a pin sized to fit within an aperture of the box so as to secure the bottom stop portions to one another, and hence secure the tapes to one another when the coupling elements of the slide fastener are coupled.

The coupling and uncoupling directions may be referred to as sliding directions of the slider. The sliding directions may be generally parallel to a longitudinal axis of the stringer/slide fastener. The sliding directions may be generally parallel to the lengths of the tapes.

In accordance with the first aspect of the invention, the first tape may further comprise a first cord located along the inner edge of the first tape and configured to fix the row of coupling elements to the first tape, the second tape may further comprise a second cord located along the inner edge of the second tape and configured to fix the row of coupling elements to the second tape, the one or both extension portions may not include a cord. The cord of the respective tape may not extend beyond the bottom stop. It will be appreciated that the cords may be separated from the tapes comprising an extension portion by removing, such as by cutting, a portion of the tape to which the cords are attached.

In accordance with the first aspect of the invention, at least one of the tapes may comprise strengthening material positioned adjacent the bottom stop. It will be appreciated that said strengthening material may be composed of a fabric such as taffeta, or may be composed of a polymer such as nylon, or may be composed of any other suitable reinforcement material. The strengthening material may be fixed to the tape by gluing, heat treatment, or by any other suitable method of adhesion.

In accordance with the first aspect of the invention, the strengthening material may be in contact with the bottom stop and may extend away from said bottom stop and parallel to the width of the tape such that it does not contact the outer edge of the tape. That is to say, the strengthening material may be applied to the tape such that it leaves a region of the tape between the outer edge of the tape and an edge of the strengthening material in which the strengthening material is not applied to the tape.

In accordance with the first aspect of the invention, the strengthening material may extend beyond the bottom stop parallel to the length of the tape and into the extension portion of the respective tape. The distance to which the strengthening material extends beyond the bottom stop may be any appropriate distance.

In accordance with the first aspect of the invention, the extension portion of at least one of the tapes may comprise a side edge generally parallel to the outer edge of said tape; and wherein said tape comprises a transverse edge perpendicular to said side edge of the extension portion; and wherein said side edge and said transverse edge are connected by an arcuate region of the extension portion. The transverse edge may adjoin the bottom stop or a portion of the bottom stop. The transverse edge may be located at a position which is axially aligned along the longitudinal axis of the chain with the bottom stop or a portion of the bottom stop.

The side edge generally parallel to the outer edge of said tape may be an inner side edge.

It will be appreciated that by providing an arcuate region any fraying of the tape and/or the extension portion in the region between the side edge of the extension portion and the bottom edge of the tape may be minimised. Furthermore, the arcuate region ensures that the likelihood of a sharp edge or corner (which may injure a user) being formed between the extension portions and the tape when the extension portions are folded along the bottom edges of the tape is greatly reduced.

In accordance with the first aspect of the invention, the extension portion of at least one of the tapes may comprise: a first portion, part of which is axially aligned with the bottom stop, and a second portion adjacent to the first portion and axially spaced from the bottom stop, the first portion having a first width and a first axial length, the second portion having a second width and a second axial length; and wherein the width of the first portion is less than the width of the second portion.

The first length of the first portion may be less than the second length of the second portion. It will be understood that the term "axial" refers to a direction generally parallel to that in which the coupling elements extend along the tape and hence a direction extending along the length of the tape. Furthermore it will be understood that the term "spaced from" is intended to define that the second portion is located axially further from the bottom stop than the first portion in the uncoupling direction of slider movement. As such, the first portion interposes the second portion and the bottom stop.

In accordance with the first aspect of the invention, the width of the extension portion of at least one of the tapes may be between 20% to 70% of the width of the portion of said respective tape which does not form part of said extension portion.

In accordance with the first aspect of the invention, the width of the extension portion of at least one of the tapes may be between 20% to 60% of the width of the portion of said respective tape which does not form part of said extension portion.

In accordance with the first aspect of the invention, the width of the extension portion of at least one of the tapes may be between 40% to 60% of the width of the portion of said respective tape which does not form part of said extension portion.

In accordance with the first aspect of the invention, the width of the extension portion of at least one of the tapes is between 47% to 60% of the width of the portion of said respective tape which does not form part of said extension portion.

It will be appreciated that in some embodiments the width of the extension portion of at least one of the tapes may be any appropriate proportion (for example, less than 20% or more than 70%) of the width of the portion of said respective tape which does not form part of said extension portion.

The extension portion may be long enough to enable it to be folded back on itself one or more times.

In accordance with the second aspect of the invention, there may be provided an article including a slide fastener chain according to the first aspect of the invention. The slide fastener may include any of the optional features discussed above in relation to the first aspect of the invention.

In accordance with the second aspect of the invention, there may be provided an article including a slide fastener chain in which the extension portion is folded, relative to a remaining portion of the tape which may include the extension portion, along an axis which is generally perpendicular to the outer edge of the tape.

In accordance with the second aspect of the invention, there may be provided an article including a slide fastener chain in which a first fold portion of the extension portion is folded, so as to be opposed to a second fold portion of the extension portion, along an axis generally parallel to the outer edge of the tape. The portion of the extension portion which is folded along an axis generally parallel to the outer edge of the tape may be a bottom portion. The bottom portion may be axially spaced along the chain axis from the bottom stop portion of the respective tape of which the extension portion forms part.

The second portion may include the first and second fold portions.

It will be appreciated that the extension portion may be folded one or more times, such that the folded extension portion creates a hem. The folds of the extension portion which create the hem may be generally perpendicular to the longitudinal axis of the chain. It follows that the hem created by the folding may be generally perpendicular to the longitudinal axis of the chain. It will be appreciated that the chain of the slide fastener may be secured to the article such that the folded extension portion is attached (for example by sewing) such that a hem of the folded extension portion is directly attached to the article. In particular, the chain of the slide fastener may be secured to the article such that the hem formed by the folded extension portion is attached to a hem of the article.

According to a third aspect of the invention there is provided a method of producing a slide fastener chain, the slide fastener chain comprising a first tape comprising an inner edge and an outer edge; and a second tape comprising an inner edge and an outer edge; and wherein the first tape comprises a row of coupling elements fixed along the inner edge of the first tape; and the second tape comprises a row of coupling elements fixed along the inner edge of the second tape; the coupling elements of the first and second tapes being arranged such that coupling elements of the first tape may interdigitate with coupling elements of the second tape so as to secure the first and second tapes together; and wherein the chain comprises a bottom stop; and wherein the at least one of the tapes is provided with an extension portion which extends beyond the bottom stop; and wherein the method comprises the step of reducing a width of the extension portion such that said width of the extension portion is less than a width of a portion of the respective tape which does not form part of said extension portion.

The first tape may comprise a first bottom stop portion and the second tape may comprise a second bottom stop portion detachably attachable to the first bottom stop portion. The bottom stop may comprise the first and second bottom stop portions. The one or both extension portions may extend beyond the respective bottom stop portion of said tape. That is to say, if a tape of the chain includes an extension portion, then the extension portion may extend beyond the bottom stop portion of the tape that includes the extension portion.

It will be appreciated that the step of reducing the width of the extension portion may be achieved by cutting the extension portion, or may be achieved by folding the extension portion back upon itself or both. It will further be appreciated that the extension portion may comprise folded material such that when unfolded the extension portion may be the same width of the remaining portion of the tape or wider than the width of the remaining portion of the tape.

It will be understood that the width of the tape is the width of the tape measured between the inner edge of the tape and the outer edge of the tape. It will further be understood that the width of each extension portion is the width measured between an inner side edge of the extension portion and an outer side edge of the extension portion. It will be appreciated that the outer side edge of the extension portion may be collinear and/or integral with the outer edge of the tape.

It will be appreciated that the extension portions of each tape may be integral with the tape such that the extension portions and the tape are formed as one piece. Alternatively, the extension portions may be formed of a separate material to the tape. It will be appreciated that the extension portions may be formed by cutting or severing of the tape or the separate material. Additionally or alternatively the extension portions may be formed by folding of the tape or the separate material.

In accordance with the third aspect of the invention, the cords may not extend beyond the bottom stop. The first tape may further comprise a first cord located along the inner edge of the first tape and configured to fix the row of coupling elements to the first tape, the second tape may further comprise a second cord located along the inner edge of the second tape and configured to fix the row of coupling elements to the second tape. The one or both extension portions may not include a cord. This may be because the cord of the respective tape may not extend beyond the bottom stop.

In accordance with the third aspect of the invention, the width of the extension portion of at least one of the tapes is between 20% to 70% of the width of the portion of said respective tape which does not form part of said extension portion.

In accordance with the third aspect of the invention, the width of the extension portion of at least one of the tapes is between 20% to 60% of the width of the respective tape.

In accordance with the third aspect of the invention, the width of the extension portion of at least one of the tapes is between 40% to 60% of the width of the portion of said respective tape which does not form part of said extension portion.

In accordance with the third aspect of the invention, the width of the extension portion of at least one of the tapes is between 47% to 60% of the width of the portion of said respective tape which does not form part of said extension portion.

It will be appreciated that in some embodiments the width of the extension portion of at least one of the tapes may be any appropriate proportion (for example, less than 20% or more than 70%) of the width of the portion of said respective tape which does not form part of said extension portion.

It will be appreciated that the method may comprise severing at least one of the tapes below the bottom stop to provide the extension portions. It will be appreciated that the method may further comprise applying strengthening material atop one or both tapes prior to or after a severance of the tapes. It will further be appreciated that the method may comprise cutting of the tapes by any appropriate method, for example, laser cutting of the tapes.

Reducing the width of the extension portion such that said width of the extension portion is less than a width of a portion of the respective tape which does not form part of said extension portion may comprise cutting the respective tape. Reducing the width of the extension portion such that said width of the extension portion is less than a width of a portion of the respective tape which does not form part of said extension portion may comprise a plurality of cuts of the respective tape. The plurality of cuts may occur simultaneously or separately.

Reducing the width of the extension portion such that said width of the extension portion is less than a width of a portion of the respective tape which does not form part of said extension portion may comprises folding the respective tape.

In accordance with a fourth aspect of the invention there is provided a method of incorporating a slide fastener into an article, the slide fastener comprising: a first tape comprising an inner edge and an outer edge; and a second tape comprising an inner edge and an outer edge; and wherein the first tape comprises a row of coupling elements fixed along the inner edge of the first tape; and the second tape comprises a row of coupling elements fixed along the inner edge of the second tape; the coupling elements of the first and second tapes being arranged such that the coupling elements of the first tape may interdigitate with the coupling elements of the second tape so as to secure the first and second tapes together; and wherein the chain comprises a bottom stop; and wherein the at least one of the tapes is provided with an extension portion which extends beyond the bottom stop; wherein a width of said extension portion is less than a width of a portion of said respective tape which does not form part of said extension portion; the method including: folding the extension portion, relative to a remaining portion of the respective tape, along an axis which is generally perpendicular to the outer edge of the tape; and attaching the first and second tapes to said article.

The first tape may comprise a first bottom stop portion and the second tape may comprise a second bottom stop portion detachably attachable to the first bottom stop portion. The bottom stop may comprise the first and second bottom stop portions. The one or both extension portions may extend beyond the respective bottom stop portion of said tape. That is to say, if a tape of the chain includes an extension portion, then the extension portion may extend beyond the bottom stop portion of the tape that includes the extension portion.

According to a fifth aspect of the invention there is provided a slide fastener including a chain according to the first aspect of the invention and a slider slidably mounted to the coupling elements of each of the tapes of the chain.

According to a sixth aspect of the invention there is provided an article including a slide fastener according to the fifth aspect of the invention.

According to a seventh aspect of the present invention there is provided a slide fastener chain comprising a first tape comprising an inner edge and an outer edge; and a second tape comprising an inner edge and an outer edge; and wherein the first tape comprises a row of coupling elements fixed along the inner edge of the first tape; and the second tape comprises a row of coupling elements fixed along the inner edge of the second tape; the coupling elements of the first and second tapes being arranged such that the coupling elements of the first tape may interdigitate with coupling elements of the second tape so as to secure the first and second tapes together; and wherein the first tape comprises a first bottom stop portion and the second tape comprises a second bottom stop portion detachably attachable to the first bottom stop portion; and wherein the at least one of the tapes is provided with an extension portion which extends beyond the respective bottom stop portion of said tape; and wherein a width of said extension portion is less than a width of a portion of said respective tape which does not form part of said extension portion.

Any of the optional features which have been discussed above in relation to one aspect of the invention may be readily applied to another aspect of the invention in an appropriate manner.

Although it is doubtlessly already apparent, but for the avoidance of doubt, in some embodiments each of the tapes may include a generally identical extension portion. In other embodiments each tape may include an extension portion which is different to that of the other tape. In some embodiments only one of the tapes may include an extension portion.

The above and other objects and features of the present invention will become clear from the following detailed description of the invention taken in conjunction with the accompanying drawings and which illustrate by way of example, prepared embodiments which the invention may assume in practice.

That is, for a better understanding, the invention is now further described by means of specific common non-limiting embodiments illustrated in the following figures in which like numbers designate like components through all figures.

EMBODIMENTS

Figure 1:
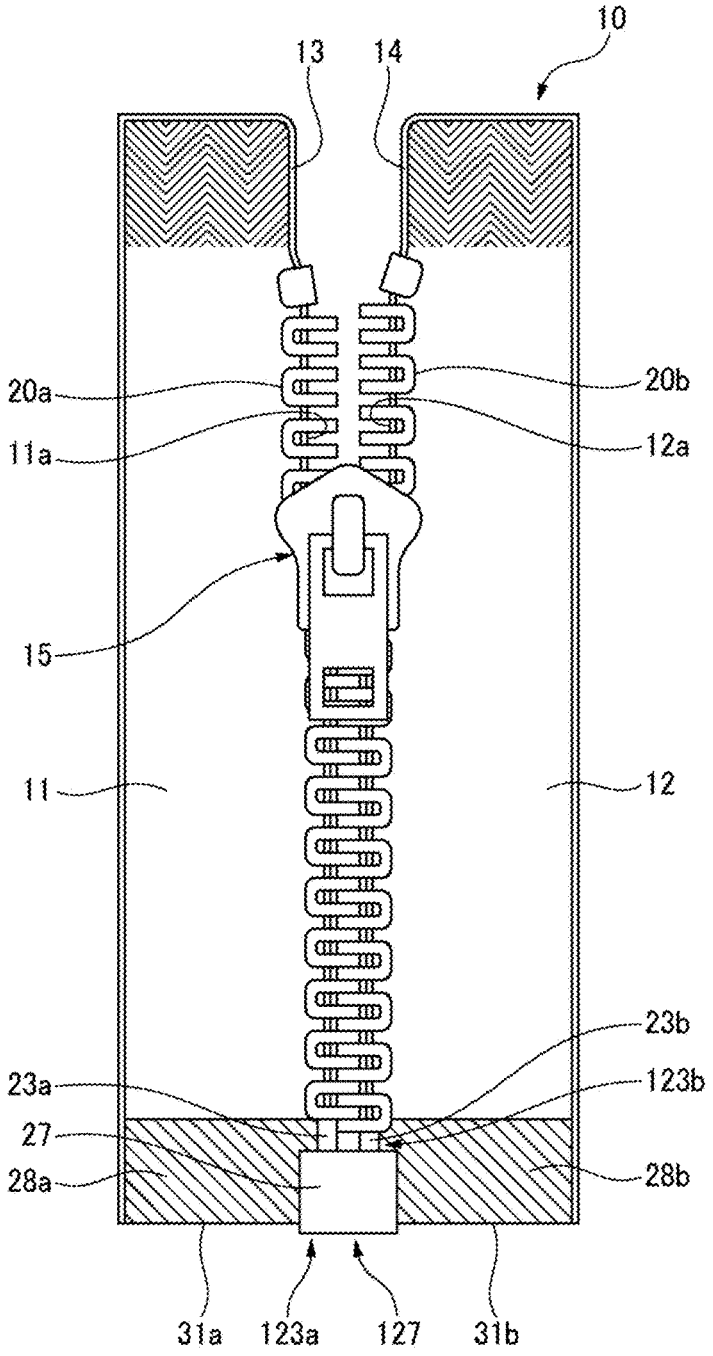
FIG. 1 is a plan view of a conventional slide fastener.

In FIG. 1 there is shown a slide fastener 10 which comprises a chain including a first stringer tape 11 and a second stringer tape 12. The tapes carry rows of continuous coupling elements 20*a* and 20*b* secured to longitudinal cords 13 and 14 respectively along inner edges 11*a* and 12*a* of the tapes 11 and 12 respectively. In other embodiments the coupling elements may be discrete to one another. A slider 15 is also shown. The slider is reciprocally movable along the rows of coupling elements and causes the coupling elements 20*a*, 20*b* to either interdigitate or disengage, and thereby either close or open the slide fastener 10 as the slider moves over the coupling elements in a manner well known in the art. The slider moves along the chain relative to the tapes in a first sliding direction to cause the coupling elements to interdigitate; and in a second sliding direction, opposite to the first sliding direction to cause the coupling elements to disengage.

Also shown are pieces of strengthening material 28*a* and 28*b*, provided on each of the tapes 11 and 12 of the chain respectively. The strengthening material 28*a*, 28*b* is applied to the slide fastener tapes at one or both ends of the coupling elements 20*a*, 20*b*. In the case shown in FIG. 1, the strengthening material 28*a*, 28*b* is applied only at one end of the tapes. The purpose of the strengthening material 28*a*, 28*b* is to reinforce the tape in the vicinity of the bottom stop portions, as these are the regions of the slide fastener chain which will most frequently be handled by a user. As such, the strengthening material 28*a*, 28*b* may be composed of any suitable material having comparable or higher strength than the tape material, such as (by way of example only) taffeta, or nylon. Although, in the present embodiment, the strengthening material is applied to reinforce the tape in the vicinity of the bottom stop portions, in other embodiments, in addition or in the alternative, the strengthening material may be applied to reinforce the tape in the vicinity of the top stop portions.

The chain of FIG. 1 further comprises a bottom stop 127 which includes bottom stop pins 23*a*, 23*b* and a box 27. In order to produce the slide fastener shown in FIG. 1, the box is non-releasably attached to one of the bottom stop pins 23*a*. The box 27 is arranged to releasably receive the other of the bottom stop pins 23*b*. The one of the bottom stop pins 23*a* and attached box 27 may be said to form a first bottom stop portion 123*a*, and the other of the bottom stop pins 23*b* may be said to form a second bottom stop portion 123*b*. The bottom stop pin 23*b* is arranged to fit within an aperture of the box 27 so as to secure the first and second bottom stop portions to one another (thereby securing the bottom of the first stringer 11 to the bottom of the second stringer 12). Another purpose of the bottom stop portions (and in particular the purpose of the box 27 of the first bottom stop portion) is to prevent movement of the slider beyond the end of the coupling elements 20*a*, 20*b* in the uncoupling direction.

The bottom stop portions (e.g. the box 27 and bottom stop pin 23*b*) are detachable. That is to say the bottom stop portion of one tape can be separated from the bottom stop portion of the other tape. In this way, the two tapes can be separated from one another at the bottom stop. The bottom stop portions can, if desired, subsequently be re-attached to one another such that the tapes are once more joined together at the bottom stop.

As is common for an open end slide fastener of the type shown in FIG. 1, the stringer tapes 11 and 12 have been cut below the bottom stop pins 23*a*, 23*b* to form the bottom edges 31*a*, 31*b* of the tapes 11, 12. Strengthening material 28*a*, 28*b* is located at the bottom edges 31*a* and 31*b* to prevent fraying of the tapes 11, 12 at the cut bottom edges 31*a*, 31*b*.

Figure 2:
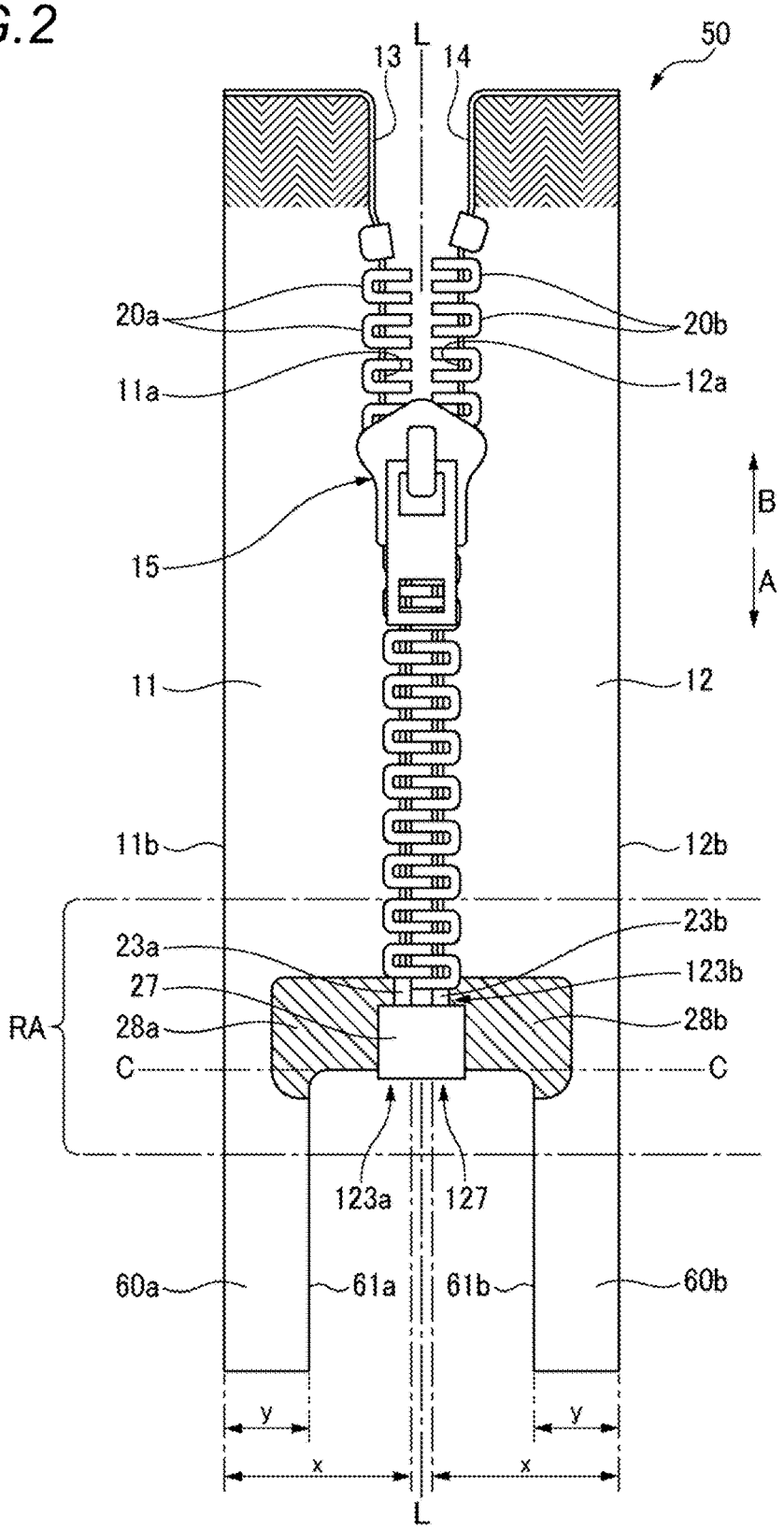
FIG. 2 is a plan view of a slide fastener according a first embodiment of the present invention.
Figure 3:
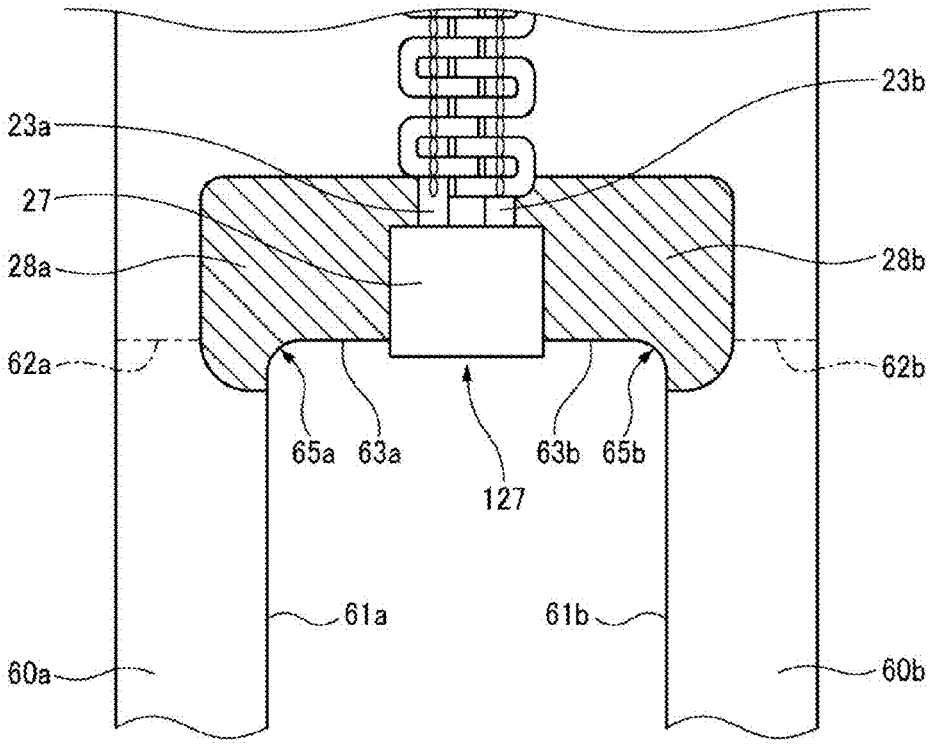
FIG. 3 is an enlarged plan view of a region of the slide fastener shown in FIG. 3.

FIGS. 2 and 3 illustrate a slide fastener (a slide fastener chain) 50 according to a first embodiment of the present invention. As with the conventional slider fastener illustrated in FIG. 1, the slide fastener of the present invention comprises chain tapes 11 and 12 which extend along a longitudinal axis L of the chain (and hence stringers). The tapes have rows of coupling elements 20*a* and 20*b* extending along respective longitudinal edges of cords 13 and 14. As in known slide fasteners a slider 15 is also present and can be moved reciprocally along the rows of coupling elements to interdigitate or disengage the coupling elements and thereby open or close the slide fastener. In more detail, if the slider is slid along the tapes (and hence coupling elements) in a first sliding direction A then this will cause the coupling elements of the tapes to disengage/separate. If the slider is slid along the tapes in a second sliding direction B (opposite the first sliding direction) then this will cause the coupling elements of the tapes to interdigitate/engage. Both the first and second sliding directions are generally parallel to the longitudinal axis of the stringer/chain/slide fastener.

In contrast to a conventional slide fastener, in the embodiment of the invention illustrated in FIGS. 2 and 3, the stringer tapes 11 and 12 extend beyond the strengthening material 28*a*, 28*b*; the coupling elements 20*a*, 20*b*; and the bottom stop 127 (and hence bottom stop portions 123*a*, 123*b*) to form elongate regions (also referred to as extension portions) 60*a*, 60*b*. The elongate regions 60*a*, 60*b* may be folded back along the length of the slide fastener before the slide fastener is sewn into place (i.e. the elongate regions may be folded along an axis C generally perpendicular to the length of the tapes in an axial direction, i.e. along an axis C generally perpendicular to axis L).

A suitable portion of the tape and cord on each of the stringer tapes 11 and 12 is removed along their respective lengths to form the extension portions 60*a* and 60*b*. That is, both tape and cord have been removed below bottom stop portions 123*a*, 123*b* on each stringer tape to form the extension portions 60*a* and 60*b*. The tape and cord removed below the bottom stop portions has reduced the width y of the extension portions 60*a*, 60*b* as compared to the width x of the portions of the respective tapes which do not form part of the extension portions. In other embodiments only cord on each of the stringer tapes may be removed along their respective lengths to form the extension portions.

In a similar manner to that discussed above in relation to FIG. 1, the slide fastener shown in FIG. 2 is such that one of the bottom stop portions 123*a* is provided with a box 127. The structure and operation of the bottom stop 127 as shown in FIG. 2 is the same as that discussed above in relation to FIG. 1. Consequently, to avoid repetition, this is not set out again here.

In FIG. 3 there is shown an expanded view of region RA in FIG. 2, in which the extension portions 60*a*, 60*b* are visible along with strengthening material 28*a*, 28*b* and bottom stop portions 123*a* and 123*b* on each tape 11, 12 of the slide fastener 50. Extension portions 60*a*, 60*b* comprise side edges, 61*a*, 61*b* generally perpendicular to transverse edges 63*a*, 63*b* the tapes 11, 12 respectively. The transverse edges 63*a*, 63*b* are so named as they are generally perpendicular to the axial length of the slide fastener 50. The respective transverse edges 63*a*, 63*b* and side edges 61*a*, 61*b* (which may also be referred to as inner side edges) are connected by arcuate regions 65*a* and 65*b*. The shape of the extension portions 60*a*, 60*b* are formed when the tape, cord and strengthening material are severed on each side of the chain (so as to remove material along the edges of the extension portions as shown in FIGS. 2 and 3). That is, the extension portions 60*a*, 60*b* are formed by cutting regions including the inner edges 11*a*, 12*a* of the tapes 11 and 12 in a state where the cords 13 and 14 and the strengthening material 28*a*, 28*b* are disposed on the pair of tapes 11 and 12. In some examples, when the coupling elements 20*a*, 20*b* are fixed to the pair of tapes 11 and 12 and the strengthening material 28*a*, 28*b* are not disposed on the pair of tapes 11 and 12, regions including the inner edges 11*a*, 12*a* of the tapes 11 and 12 and the coupling elements 20*a*, 20*b* may be cut. The bottom stop pins 23*a*, 23*b* may be attached to the respective tapes 11 and 12 before the cutting and the box 27 may be attached to the one of the bottom stop pins 23*a* at a position below end portions of the bottom stop pins 23*a*, 23*b* after cutting the regions. In other examples, after cutting the regions, the bottom stop pins 23*a*, 23*b* may be attached to the respective tapes 11 and 12 and the box 27 may be attached to the one of the bottom stop pins 23*a*.

The arcuate region 65*a*, 65*b* may be of a constant or varying radius. Whilst it will be appreciated that, in accordance with the present invention, the angle subtended by the arcuate region may vary, it is advantageous if the arcuate region does not subtend a right angle. Use of an arcuate region provides a more aesthetically pleasing alignment of the extension portions when folded about fold lines 62*a* and 62*b* (which lie on axis C) and also avoids sharp protrusions, which may engage with a wearer of the garment when closing or opening the slide fastener. When it is desired to integrate the slide fastener chain 50 into a garment, the extension portions 60*a*, 60*b* may be folded back upon themselves along an axis preferably collinear to a transverse edge 63*a*, 63*b* before being sewn in place. The fold lines for this and other described embodiments are generally perpendicular to the longitudinal axis L of the chain.

Whilst the strengthening material 28*a*, 28*b* is illustrated on each tape of the slide fastener depicted in FIG. 2, it will be appreciated that the strengthening material may be present adjacent the bottom stop pins on each side of both tapes 11, 12. The strengthening material usually extends across the tapes and beyond the bottom stop pins and over part of the extension portions. However, in some embodiments, the strengthening material may not extend to the outer edge of at least one of the tapes (or extension portion).

It will be seen from FIG. 2 that the stringer tapes 11, 12 each define a width x measured between the inner edges 11*a*, 12*a* and the outer edge 11*b*, 12*b* of each tape respectively. The width x is the width of a portion of tape which does not form part of an extension portion. Furthermore, the extension portions 60*a*, 60*b* each define a width y measured between the outer edges 11*b*, 12*b* and the side edges 61*a*, 61*b* of each tape respectively. In accordance with the present invention it is preferred that the width y of the extension portions is about 20% to 70% of the width x of the stringer tapes 11, 12. More preferably, the extension portions on one or both tapes have a width y that is about 20% to 60% of the width x; about 40% to 60% of the width x; or most preferably about 47% to 60% of the width x. It will be appreciated that in some embodiments the width of the extension portion of at least one of the tapes may be any appropriate proportion (for example, less than 20% or more than 70%) of the width of the tape.

The widths are measured perpendicular to the longitudinal axis L of the chain.

Figure 4:
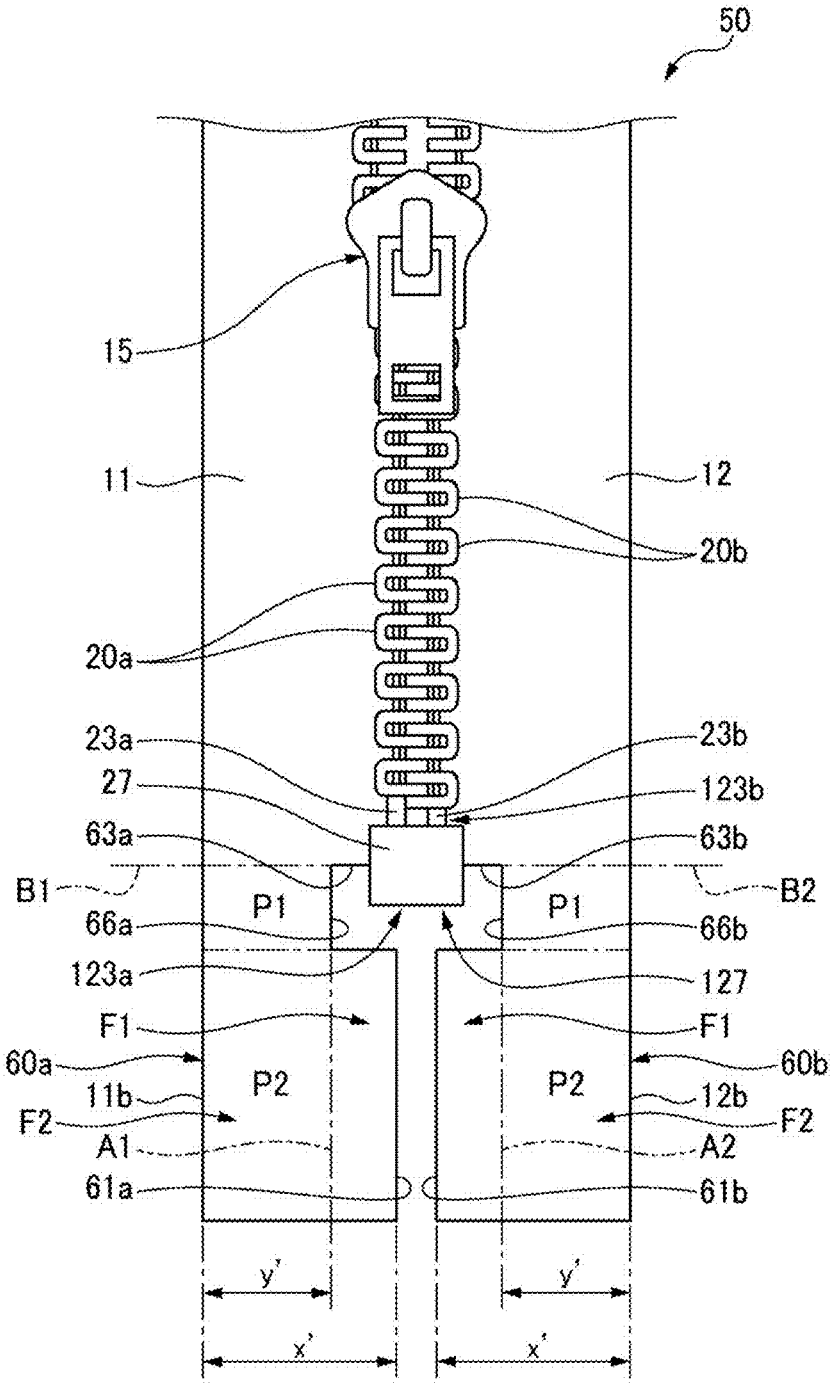
FIG. 4 is an enlarged plan view of an alternative embodiment of a slide fastener according to the present invention.

FIG. 4 shows a slide fastener (a slide fastener chain) 50 according to an alternative embodiment of the present invention. The tapes 11, 12 comprise extension portions 60*a* and 60*b* respectively. Each extension portion 60*a*, 60*b* comprises a first portion P1 axially aligned with a transverse edge 63*a*, 63*b* of the tapes 11, 12. The first portion P1 is also axially aligned with the bottom stop 127 (and hence bottom stop portions 123*a*, 123*b* of the tapes 11, 12). Each extension portion 60*a*, 60*b* further comprises a second portion P2 located adjacent to the first portion P1 and axially spaced from the bottom stop portions 123*a*, 123*b*. That is to say, the second portion P2 is located further along the tapes 11, 12 than the first portion P1, such that the first portion P1 interposes the second portion P2 and the bottom stop portions 123*a*, 123*b*.

It will be seen from the figure that each of the first and second portions P1, P2 define an axial length (i.e. parallel to the direction of movement of the slider 15, parallel to the longitudinal axis of the chain). In a preferred embodiment, the axial length of the first portion P1 is less than the axial length of the second portion P2.

It will further be seen from the figure that the second portions P2 define a width x' measured between an inner edge 61*a*, 61*b* of the respective extension portions 60*a*, 60*b* of the tapes 11, 12 and the outer edge 11*b*, 12*b* of the tapes 11, 12. Whereas, the first portions P1 define a width y', extending substantially parallel to the width y, defined between an edge 66*a*, 66*b* of the respective extension portions 60*a*, 60*b* of the tapes 11, 12 and the outer edge 11*b*, 12*b* of the tapes 11, 12. In a preferred embodiment, the widths y' of the first portions P1 are less than the widths x' of the second portions P2.

When the slide fastener including the slide fastener chain 50 is desired to be integrated into a garment, either of the extension portions 60*a*, 60*b* may be folded along respective axes A1, A2 collinear to respective edges 66*a*, 66*b* of the first portion P1. In this way first fold portions F1 of the extension portions 60*a*, 60*b* are folded, so as to be opposed to respective second fold portions F2 of the extension portions 60*a*, 60*b*, along a respective axis A1, A2 generally parallel to the outer edge 11*b*, 12*b* of the tapes 11, 12. The extension portions 60*a*, 60*b* may also be folded along respective axes B1, B2 collinear with respective transverse edges 63*a*, 63*b*. Folding the extension portions in this way (as with other embodiments of the invention) helps to minimise fraying of the tapes, particularly along edges of the tape which have been cut.

It will be appreciated that the embodiment of the present invention depicted in FIG. 4 also defines a width x of the tapes 11, 12 in an identical manner to the width x defined with respect to the embodiment of FIGS. 2 and 3. Furthermore, as described above with respect to the embodiment of FIGS. 2 and 3, it is preferred that the width y of the extension portions is about 20% to 70% of the width x of the stringer tapes 11, 12. More preferably, the extension portions on one or both tapes have a width y that is about 20% to 60% of the width x; about 40% to 60% of the width x; or most preferably about 47% to 60% of the width x. It will be appreciated that in some embodiments the width of the extension portion of at least one of the tapes may be any appropriate proportion (for example, less than 20% or more than 70%) of the width of the tape. For example, in some embodiments an extension portion may have a width of about 1% of the width of the rest of the tape, which may, for example be about 1 m.

It will be appreciated that whilst the strengthening material illustrated in FIGS. 1-3 is not present in FIG. 4, the embodiment of FIG. 4 may comprise such strengthening material. It will be appreciated that the strengthening material has been omitted from FIG. 4 simply for reasons of clarity and is not limiting on the embodiment depicted by the figure.

In any of the embodiments previously discussed, the width of the extension portion may be chosen such that, when the extension portion is folded back along the length of the slide fastener in a manner such that the outer edge of the extension portion rests on the outer edge (11*b*, 12*b*) of the tape of which the extension portion forms part, the inner edge of the extension portion does not lie within the region of the tape along which the slider passes as the slider moves relative to the tapes in either of the sliding directions. In other words, the width of the extension portion may be chosen such that, when the extension portion is folded back along the length of the slide fastener in a manner such that the outer edge of the extension portion rests on the outer edge (11*b*, 12*b*) of the tape of which the extension portion forms part, the slider will not collide with the extension portion as the slider moves relative to the tapes in either of the sliding directions.

Figure 5:
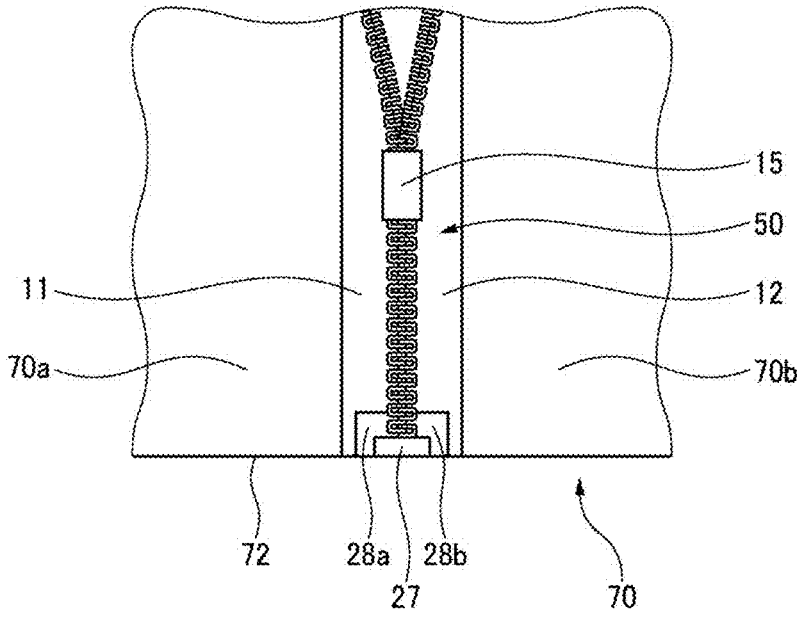
FIG. 5 is a schematic view of an article including a slide fastener according to any of the embodiments shown in FIGS. 2 and 3 and FIG. 4.

FIG. 5 shows a schematic view of an article 70 including a slide fastener 50 including a chain according to any of the embodiments of the invention discussed above. Although only shown schematically in FIG. 5, the bottom stop 27 is of the separable type as discussed above in relation to the earlier figures. In the embodiment shown, the slide fastener 50 is an open end slide fastener, although this need not be the case in other applications. The article 70 includes first and second portions 70*a* and 70*b*. The slide fastener is used to open and close a separation between the first and second portions 70*a* and 70*b*. In this way, when the slide fastener is in a closed configuration, the slide fastener closes the separation between the first and second portions 70*a* and 70*b* and attaches the first and second portions 70*a* and 70*b* together. The slide fastener 50 is aligned with the article 70 such that the bottom stop 27 and/or fold lines 62*a* and 62*b* (which lie on axis C) are generally aligned with an edge 72 of the article. In one example the edge of the article may be the bottom edge of the front of a jacket.

The slide fastener is attached to the article by any appropriate method, including, but not limited to stitching, welding and adhesive. The first tape 11 is attached to the first portion 70*a* of the article, and the second tape 12 is attached to the second portion 70*b* of the article. Before attaching the tapes to the article, the extension portions of the tapes are folded back (e.g. along fold lines 62*a*, 62*b*) as previously discussed.

In some embodiments of the present invention the slide fastener may be provided to the customer in a state in which the extension portions of the tapes have been pre-folded in any of the manners discussed above. The pre-folded tapes may be such that the extension portions are secured to the rest of their respective tape, once folded, in any appropriate manner, including, but not limited to gluing, welding, stitching or other appropriate method.

The extension portions may be of a sufficient width to allow the chain to be neatly sewn into a garment when the extension portions are folded backwards along a fold line perpendicular to the longitudinal axis of the chain and aligned with the tapes above the bottom stop portions, and are also of a narrow enough width and shape to provide a non-bulky appearance to the garment when the slide fastener is in place.

The inventors have found that by creating narrow extension portions 60*a* and 60*b*, when the slide fastener is sewn into a garment composed of lightweight or fine material such as eveningwear and sportswear garments, the reduced width of folded stringer tape in the vicinity of the bottom stop portions leads to an improved aesthetic appearance of the stringer/chain in the finished product.

It will be appreciated that a portion of the tape, cord and strengthening material may be severed on each tape of the chain to form extension portions 60*a*, 60*b*.

In addition, in accordance with the present invention it is now possible to prepare improved slide fastener stringers and chains in which the size of the extension portions is reduced and which readily allow the extension portions to be folded back against the slide fastener tapes thereby providing a slide fastener of reduced thickness for sewing into a garment.

The slide fastener of the present invention with extension portions of reduced width as described above therefore allows for the creation of much smoother lines on a garment when the slide fastener is sewn in place.

Whilst specific bottom stop portions have been described above, it will be appreciated that an embodiment of the invention may include any appropriate bottom stop portions which are detachably attachable to one another.

Furthermore, although the embodiments of the invention described above relate to slide fasteners which are open end—i.e. which include a bottom stop having first and second detachably attachable bottom stop portions, in other embodiments, the bottom stop may be any appropriate bottom stop. For example, in some embodiments the bottom stop may permanently attach the tapes of the chain of the slide fastener together. It follows that the invention is equally applicable to closed end slide fasteners.

The invention claimed is:

1. A slide fastener chain comprising:

a first tape comprising an inner edge and an outer edge; and a second tape comprising an inner edge and an outer edge;

wherein the first tape comprises a row of coupling elements fixed along the inner edge of the first tape; and the second tape comprises a row of coupling elements fixed along the inner edge of the second tape;

wherein each of the first and second tape comprises a transverse edge;

wherein the coupling elements of the first and second tapes are arranged such that the coupling elements of the first tape may interdigitate with the coupling elements of the second tape so as to secure the first and second tapes together;

wherein the chain comprises a bottom stop;

wherein the at least one of the tapes is provided with an extension portion which extends beyond the bottom stop;

wherein the extension portion comprises a side edge;

wherein a width of said extension portion is less than a width of a portion of said respective tape which does not form part of said extension portion; and wherein the transverse edge of each of the first and second tapes is adjacent to the bottom stop or a part of the bottom stop.

2. The slide fastener chain according to claim 1, wherein the first tape comprises a first bottom stop portion and the second tape comprises a second bottom stop portion detachably attachable to the first bottom stop portion, and wherein the bottom stop comprises the first and second bottom stop portions; and wherein the extension portion extends beyond the respective bottom stop portion of the at least one of the tapes.

3. The slide fastener chain according to claim 1, wherein the coupling elements are configured to receive a slider, the slider being movable in a coupling direction so as to cause the coupling elements of the first and second tapes to interdigitate, and being movable in an uncoupling direction substantially opposite the coupling direction so as to cause the coupling elements of the first and second tapes to disengage; and wherein the bottom stop limits movement of the slider beyond said bottom stop in the uncoupling direction.

4. The slide fastener chain according to claim 1, wherein the first tape further comprises a first cord located along the inner edge of the first tape and configured to fix the row of coupling elements to the first tape;

wherein the second tape further comprises a second cord located along the inner edge of the second tape and configured to fix the row of coupling elements to the second tape; and wherein the one or both extension portions do not include a cord.

5. The slide fastener chain according to claim 1, wherein at least one of the tapes comprises strengthening material positioned adjacent the bottom stop.

6. The slide fastener chain according to claim 5, wherein the strengthening material is in contact with the bottom stop and extends away from said bottom stop and parallel to the width of the tape such that it does not contact the outer edge of the tape.

7. The slide fastener chain according to claim 5, wherein the strengthening material extends beyond the bottom stop and into the extension portion of the respective tape.

8. The slide fastener chain according to claim 1, wherein the side edge of the extension portion is generally parallel to the outer edge of the at least one of the tapes;

wherein the transverse edge of the at least one of the tapes is perpendicular to said side edge of the extension portion; and wherein said side edge and said transverse edge are connected by an arcuate region of the extension portion.

9. The slide fastener chain according to claim 1, wherein the extension portion of the at least one of the tapes comprises:

a first portion, part of which is aligned with the bottom stop in a width direction of the slide fastener chain, and a second portion adjacent to the first portion and spaced from the bottom stop in a direction of a longitudinal axis of the slide fastener chain;

wherein the first portion has a first width and a first length in the direction of the longitudinal axis;

wherein the second portion has a second width and a second axial length in the direction of the longitudinal axis; and wherein the first width of the first portion is less than the second width of the second portion.

10. The slide fastener chain according to claim 9, wherein the first axial length of the first portion is less than the second axial length of the second portion.

11. An article including the slide fastener chain according to claim 1.

12. The article according to claim 11 wherein the extension portion is folded, relative to a remaining portion of the tape which includes the extension portion, along an axis which is generally perpendicular to the outer edge of the tape.

13. The article according to claim 11, wherein the extension portion comprises a first fold portion and a second fold portion positioned in an outer side of the first fold portion; and wherein the first fold portion of the extension portion is folded, so as to be opposed to the second fold portion of the extension portion, along an axis which is generally parallel to the outer edge of the tape.

14. A method of producing a slide fastener chain, the slide fastener chain comprising:

a first tape comprising an inner edge and an outer edge; and a second tape comprising an inner edge and an outer edge;

wherein the first tape comprises a row of coupling elements fixed along the inner edge of the first tape; and the second tape comprises a row of coupling elements fixed along the inner edge of the second tape;

wherein each of the first tape and second tapes comprises a transverse edge;

wherein the coupling elements of the first and second tapes are arranged such that coupling elements of the first tape may interdigitate with coupling elements of the second tape so as to secure the first and second tapes together;

wherein the chain comprises a bottom stop;

wherein at least one of the tapes is provided with an extension portion which extends beyond the bottom stop;

wherein the extension portion comprises a side edge;

wherein the method comprises reducing the width of the extension portion such that said width of the extension portion is less than a width of a portion of the respective tape which does not form part of said extension portion; and wherein the transverse edge of each of the first and second tapes is adjacent to the bottom stop or a part of the bottom stop.

15. The method according to claim 14, wherein the first tape comprises a first bottom stop portion and the second tape comprises a second bottom stop portion detachably attachable to the first bottom stop portion, and wherein the bottom stop comprises the first and second bottom stop portions; and wherein the extension portion extend beyond the respective bottom stop portion of the at least one of the tapes.

16. The method of producing a slide fastener chain according to claim 14, wherein the first tape further comprises a first cord located along the inner edge of the first tape and configured to fix the row of coupling elements to the first tape;

wherein the second tape further comprises a second cord located along the inner edge of the second tape and configured to fix the row of coupling elements to the second tape; and wherein the extension portion does not include a cord.

17. The method of producing a slide fastener chain according claim 14, wherein reducing the width of the extension portion such that said width of the extension portion is less than a width of a portion of the respective tape which does not form part of said extension portion comprises cutting the respective tape.

18. The method of producing a slide fastener chain according to claim 14, wherein reducing the width of the extension portion such that said width of the extension portion is less than a width of a portion of the respective tape which does not form part of said extension portion comprises folding the respective tape.

19. A method of incorporating a slide fastener into an article, the slide fastener comprising:

a first tape comprising an inner edge and an outer edge; and a second tape comprising an inner edge and an outer edge;

wherein the first tape comprises a row of coupling elements fixed along the inner edge of the first tape; and the second tape comprises a row of coupling elements fixed along the inner edge of the second tape;

wherein each of the first and second tapes comprises a transverse edge;

wherein the coupling elements of the first and second tapes are arranged such that the coupling elements of the first tape may interdigitate with the coupling elements of the second tape so as to secure the first and second tapes together;

wherein the chain comprises a bottom stop;

wherein the at least one of the tapes is provided with an extension portion which extends beyond the bottom stop;

wherein the extension portion comprises a side edge;

wherein a width of said extension portion is less than a width of a portion of said respective tape which does not form part of said extension portion;

the method including: folding the extension portion, relative to a remaining portion of the respective tape, along an axis which is generally perpendicular to the outer edge of the tape;

and attaching the first and second tapes to said article; and wherein the transverse edge of each of the first and second tapes is adjacent to the bottom stop or a part of the bottom stop.

20. The method according to claim 19, wherein the first tape comprises a first bottom stop portion and the second tape comprises a second bottom stop portion detachably attachable to the first bottom stop portion, and wherein the bottom stop comprises the first and second bottom stop portions; and wherein the extension portion extends beyond the respective bottom stop portion of the at least one of the tapes.

* * * * *